United States Patent [19]

Yang

[11] 3,986,224

[45] Oct. 19, 1976

[54] ERASER WITH DUST-COLLECTING MEANS

[76] Inventor: Teh-tsao Yang, 24 Ku-Lin Street, Taipei, China /Taiwan

[22] Filed: May 16, 1975

[21] Appl. No.: 577,984

[52] U.S. Cl. ..... 15/114; 15/221; 15/224

[51] Int. Cl.[2] ..... B43L 21/02

[58] Field of Search ..... 15/1.5 A, 114, 221, 15/223, 224, 98 R, 399; 35/62; 401/22

[56] References Cited

UNITED STATES PATENTS

| | | | |
|---|---|---|---|
| 122,511 | 1/1872 | Bigger et al. | 15/221 |
| 511,812 | 1/1894 | Spence | 15/221 |
| 522,469 | 7/1894 | Kious | 15/221 |
| 709,722 | 9/1902 | Raber | 15/224 X |
| 1,942,205 | 1/1934 | Elnett | 15/114 |
| 3,110,917 | 11/1963 | McPeek | 15/118 |
| 3,418,673 | 12/1968 | Kruth | 15/118 |

FOREIGN PATENTS OR APPLICATIONS

| | | | |
|---|---|---|---|
| 31,659 | 12/1926 | France | 15/224 |
| 601,672 | 12/1926 | France | 15/224 |
| 1,042,202 | 10/1958 | Germany | 15/1.5 A |

*Primary Examiner*—Daniel Blum

[57] ABSTRACT

A novel structure for a blackboard eraser is provided wherein the eraser comprises a plurality of raised rows of two or more different erasing mediums such as brushes, fiber or cloths laterally spaced and extending parallel on a base support to form an eraser body. The body is connected at its two ends to a resilient dust-collecting frame flush with the raised erasing mediums so that when erasing the blackboard with the eraser the latter completely encloses the corresponding part of the blackboard, guiding the dust along the spaces between adjacent raised rows of erasing mediums and then collecting them in the frame, thereby preventing the dust from flying about and polluting the air. A chalk container may further be formed at the lower part of the eraser for holding the chalks.

7 Claims, 6 Drawing Figures

ERASER WITH DUST-COLLECTING MEANS

BACKGROUND OF THE INVENTION

Conventional erasers after repeated use usually become quite inefficient because the entire erasing surface of the eraser will then be covered with chalk dust.

Furthermore, when erasing a blackboard with conventional erasers gaps always exist between the eraser and the blackboard. As a result, dust flies about to the detriment of people's health.

SUMMARY OF THE INVENTION

One object of the present invention is to provide an eraser whose erasing surface is made up of a plurality of parallel spaced raised rows of two or more erasing mediums to improve the erasing efficiency.

Another object of the present invention is to provide an eraser with a dust-collecting frame provided therein whereby when erasing the blackboard a completely sealed space is formed between the blackboard and the eraser to prevent the chalk dust from flying around.

Still another object of the present invention is to provide an eraser which can be readily assembled and produced by a series of high speed production processes to facilitate mass production.

A further object of the present invention is to provide an eraser with a chalk container equipped therein for holding chalks.

Other objects and advantages of the present invention will become more apparent from the following detail description of the preferred embodiment of the present invention with reference to the accompanying drawings.

DETAILED DESCRIPTION OF THE PREFERRED EMBODIMENTS

The present invention generally relates to a novel structure of eraser and particularly to a blackboard eraser having dust-collecting capability.

The eraser according to the present invention comprises substantially a plurality of parallel spaced rows of erasing mediums formed on a base support and protruded therefrom to form an eraser body, and a resilient dust-collecting frame connected to the two ends of the eraser body for collecting the chalk dust.

Figure 1:
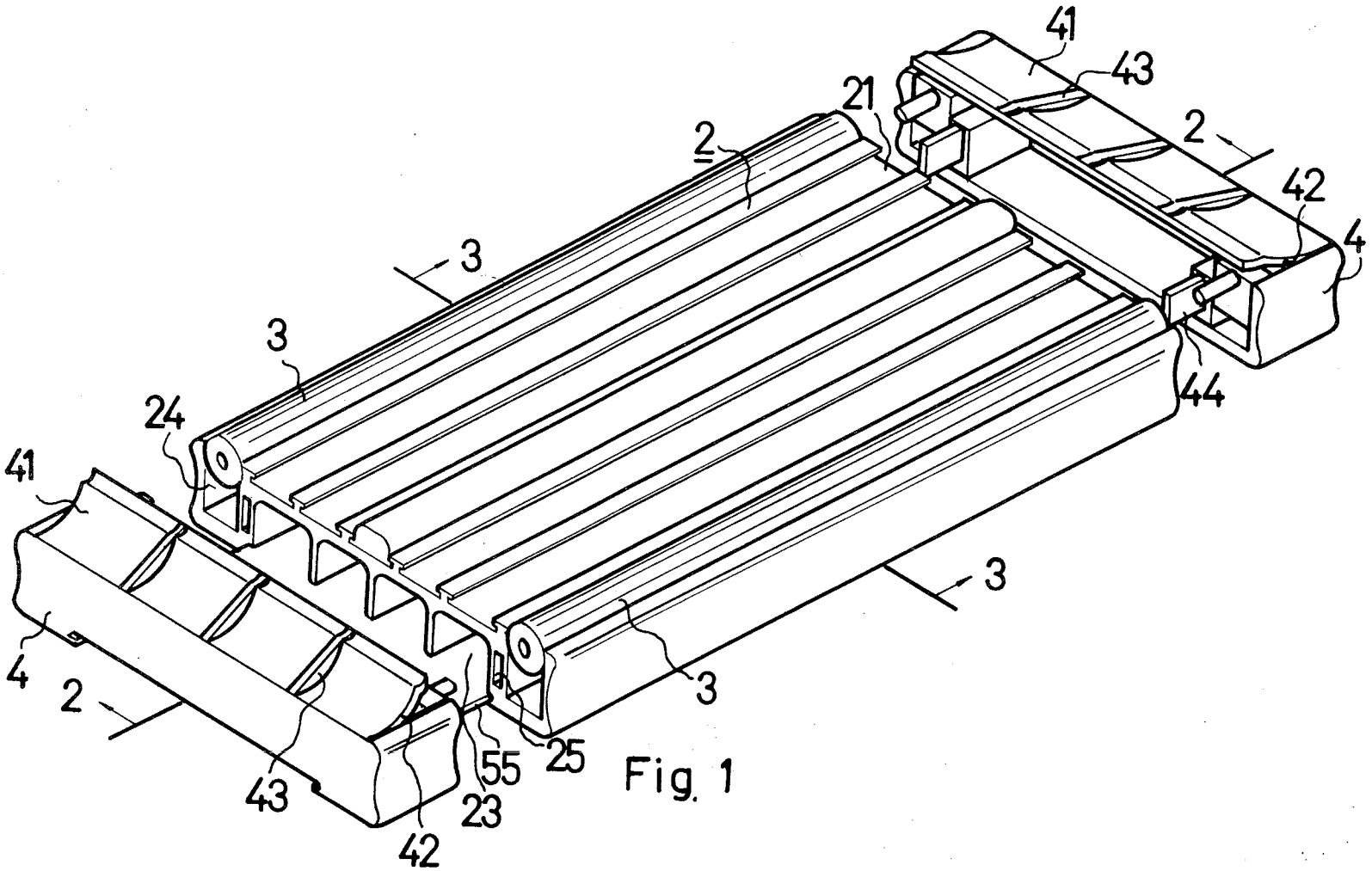
FIG. 1 is a perspective view of the eraser according to the present invention.
Figure 2:
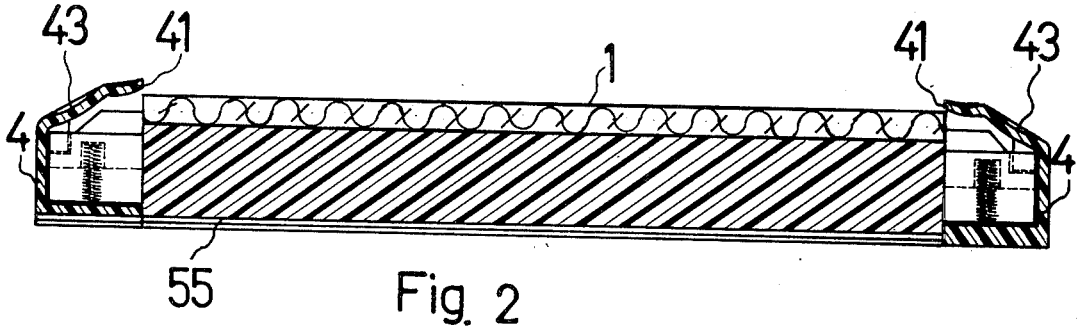
FIG. 2 is a sectional view taken from line 2—2 of FIG. 1.
Figure 3:
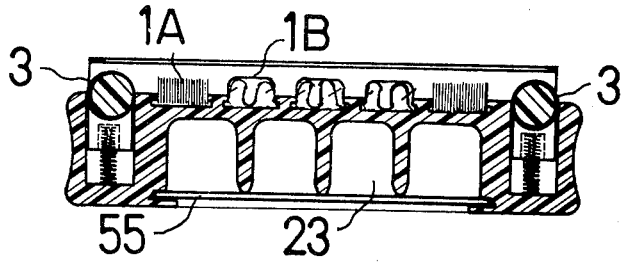
FIG. 3 is a sectional view taken from line 3—3 of FIG. 1.

FIG. 1 shows a perspective view of the eraser according to the present invention, and FIGS. 2 and 3 are the sectional views taken from lines 2—2 and 3—3 of FIG. 1, respectively. The eraser comprises an eraser body having a plurality of parallel spaced rows 1a, 1b of two or more different erasing mediums, such as brushes, cloths or fiber, alternately or otherwise arranged on a base support 2. The erasing mediums 1 may be either directly attached to the base support 2 or inserted into a preformed slot 21 on the base support (see FIG. 4) by extrusion and then fixed thereto. It can also be achieved by any other conventional methods known in the art. Rollers 3 are provided to facilitate moving the eraser over the blackboard. Elastic or resilient dust-collecting frames 4 are connected to the two ends of the eraser body, forming a space therebetween which is resiliently variable. The frames 4 are adapted to collect the chalk dust when using the eraser on a blackboard.

Figure 4:
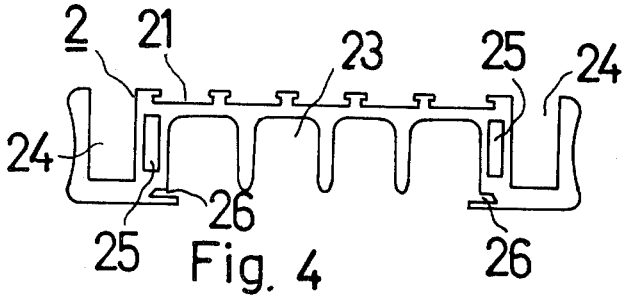
FIG. 4 is an end view of the base support according to present invention.

Refer to FIG. 4 which shows a preferred base support embodiment according to the present invention. A plurality of slots 21 are formed on the top surface of the support 2 for receiving the rows of erasing mediums. The lower part of the support 2 is partitioned into a plurality of chambers 23 which when closed by a bottom plate 55 (FIG. 1) inserted into the slots 26 can be adopted to contain chalks, making the eraser a chalk container too. Slots 24 are formed to receive the rollers 3 which decrease the friction between the eraser and the blackboard when the former is moving over the latter. Slots 25 are used for engaging with the dust-collecting frame 4 as detailed hereinbelow.

Figure 5:
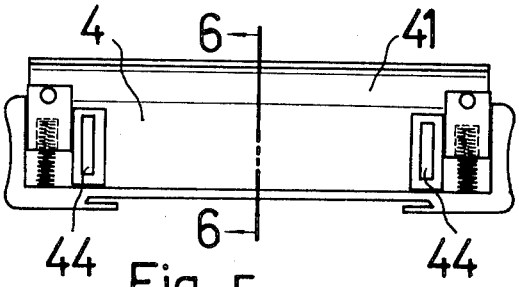
FIG. 5 is front view of the end plates or the dust-collecting frames according to the present invention.
Figure 6:
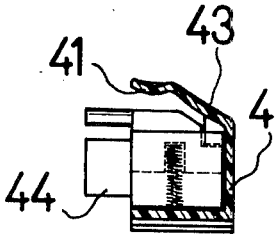
FIG. 6 is a sectional view taken from line 6—6 of FIG. 5.

FIGS. 5 and 6 show one of the hollow dust-collecting frames according to the present invention. The frames 4 are located at the two ends of the eraser and also serve as two end plates of the same. A foldable lid 41 is provided at the top of the frame 4. The lid has a side wall 42 to help enclose the chalk dust inside the eraser. The lid 41 may be further reinforced by a plurality of ribs 43, as shown in FIG. 1. The connecting members 44 of the frame are engageable with the slots 25 (FIG. 4) of the eraser body so as to achieve the connection therebetween. Because the frame is made of resilient plastic material, the distance between the lids of the frames and the eraser body is resiliently variable when using the eraser on a blackboard.

The eraser as a whole has a flat top surface surrounded by the frames and rollers with adjustable spaces formed therebetween. As a result, when using the eraser on a blackboard, the eraser will be able to completely enclose the corresponding part of the blackboard, guiding the chalk dust to fall down vertically along the passages between the adjacent protruding rows of erasing mediums and then to be collected by the dust-collecting frames. It is to be noted that the frames 4 at the two ends of the eraser and the rollers 3 or frames at two sides of the same constitute a dust-collecting mechanism, permitting the chalk dust to fall in while preventing the same from flying out. The lids engage the blackboard during use.

The arrangement of alternative rows of erasing mediums, e.g. brushes and cloths, improves the erasing efficiency. It also reduces the friction between the eraser and the blackboard. During and after use, substantialy all of the chalk dust will reside inside the eraser instead of flying around causing air pollution.

Another important feature of the present invention lies in the fact that all the components of the eraser can be produced and assembled readily by a series of manufacturing processes enabling mass production.

Though the present invention has been described by way of example hereinbefore, it is to be understood that various modifications can still be made by those skilled in the art without departing from the spirit and scope of the present invention.

What I claim is:

1. An elongated elongated eraser comprising:

an elongated base support having attachment means on an erasure side;

strips of erasing medium attached to said base support by said attachment means in spaced-apart parallel relationship forming chalk dust passages between said rows;

a pair of resilient material dust-collecting frames, each of said frames comprising a connecting member, enclosing side walls and an end wall, and a foldable lid engageable with the blackboard, each of said frames being detachably connected to a respective end of said base support with the lids directed inwardly to form a dust collecting enclosure into which said chalk dust passages empty, whereby in use dust falls along said dust passages into said dust collecting enclosure where it is trapped by said lid.

2. The elongated eraser as claimed in claim 1, wherein said erasing medium comprises separate strips of brushes and cloths.

3. The elongated eraser as claimed in claim 1, wherein: said attachment means comprises a plurality of slots for receiving said strips of erasing medium, said support has chambers for containing chalk on the side opposite the erasure side, and said eraser further includes a bottom cover for closing said chambers.

4. The elongated eraser as claimed in claim 1, wherein said connecting member comprises a plug which fits into said support, whereby said dust-collecting frames are detachable from said support.

5. The elongated eraser as claimed in claim 1, wherein said foldable lid is reinforced by rib members.

6. The elongated eraser as claimed in claim 1, including a pair of rollers, each of said rollers being mounted on a respective lateral side of said eraser parallel to said strips to reduce the friction between the eraser and a surface being erased and further restricting the movement of the dust to within the area of the eraser.

7. An elongated eraser comprising:

an elongated base support having spaced-apart parallel slots on an erasure side and having chambers for containing chalk on a side opposite said erasure side;

a bottom cover for closing said chambers;

strips of erasing medium protruding from said slots and forming chalk dust passages in the spaces between said slots and said strips;

a pair of rollers, each of said rollers being mounted on a respective lateral side of said eraser parallel to said strips to reduce the friction between the eraser and a surface being erased and to restrict the movement of dust to within the area of the eraser;

a pair of detachable dust-collecting frames of resilient, each of said frames comprising a plug which fits into said support, enclosing side walls and an end wall, and a foldable lid engageable with the blackboard, each of said frames being connected to a respective end of said base support to form a dust-collecting enclosure into which said chalk dust passages empty, whereby in use dust falls along said dust passages into said dust-collecting enclosure where it is trapped by said lid.

* * * * *